US006019545A

United States Patent [19]

Allen et al.

[11] Patent Number: 6,019,545

[45] Date of Patent: Feb. 1, 2000

[54] SURFACE FINISHING MACHINE WITH ROTATABLE GUARD

[75] Inventors: J. Dewayne Allen; Timmy D. Guinn, both of Paragould, Ark.

[73] Assignee: Allen Engineering Corporation, Paragould, Ark.

[21] Appl. No.: 09/206,130

[22] Filed: Dec. 7, 1998

[51] Int. Cl.[7] ..... E01C 19/22

[52] U.S. Cl. ..... 404/112; 451/350; 451/353; 451/451

[58] Field of Search ..... 404/112; 451/350, 451/353, 451, 454, 456; 15/236.1, 93.1, 49.1, 98

[56] References Cited

U.S. PATENT DOCUMENTS

| | | | |
|---|---|---|---|
| D. 400,544 | 11/1998 | Allen | D15/28 |
| 3,412,657 | 11/1968 | Colizza et al. | 404/112 |
| 3,973,857 | 8/1976 | Whiteman, Jr. | 404/112 |
| 4,027,991 | 6/1977 | Maass | 404/112 |
| 4,046,483 | 9/1977 | Sutherland | 404/112 |
| 4,198,178 | 4/1980 | Carlstrom et al. | 404/112 |
| 4,232,980 | 11/1980 | Terinek et al. | 404/112 |
| 4,312,603 | 1/1982 | Whiteman, Jr. | 404/112 |
| 4,320,986 | 3/1982 | Morrison | 404/112 |
| 4,386,901 | 6/1983 | Morrison | 425/456 |
| 4,388,017 | 6/1983 | Morrison | 404/112 |
| 4,629,359 | 12/1986 | Sengupta | 404/112 |
| 4,673,311 | 6/1987 | Whiteman, Jr. | 404/112 |
| 4,752,154 | 6/1988 | Valentine | 404/72 |
| 4,784,519 | 11/1988 | Artzberger | 404/112 |
| 5,221,156 | 9/1991 | Martin | 404/97 |
| 5,405,216 | 4/1995 | Allen et al. | 404/112 |
| 5,533,830 | 7/1993 | Barichello | 404/96 |

OTHER PUBLICATIONS

"BM 60 Kantafwerker" Spec. Sheet—B–Mac Daar Draait'T OM.

*Primary Examiner*—Thomas B. Will
*Assistant Examiner*—Kristine Markovich
*Attorney, Agent, or Firm*—Stephen D. Carver

[57] ABSTRACT

A motorized finishing machine has a rotatable guard system enabling it to finish concrete surfaces next to walls, posts, conduits, or other obstacles. Deployed as a concrete trowel, the machine comprises an internal combustion motor that powers a gearbox to revolve a downwardly projecting rotor. Numerous radially spaced-apart finishing blades controlled by the rotor frictionally contact the concrete surface being treated. A protective guard, which circumscribes the rotor, is rotatably suspended by a plurality of rollers. The guard, which is shaped somewhat like a truncated cone, comprises an inner ring coaxially secured above a larger diameter, outer ring. Radially spaced apart spokes extend between the upper and lower rings and brace the guard. The bearing-equipped rollers mounted by radially, spaced-apart arms have upper and lower flanges. The inner guard ring is captivated between the rollers, and it is vertically constrained between the roller flanges. When the guard contacts an obstacle it may freely rotate, enabling the power trowel to approach otherwise-unreachable surface regions without wobbling or rocking.

17 Claims, 5 Drawing Sheets

SURFACE FINISHING MACHINE WITH ROTATABLE GUARD

BACKGROUND OF THE INVENTION

1. Field of the Invention

This invention relates generally to powered surface finishing machines, including walk-behind trowels for finishing concrete surfaces of the type classified in United States Patent Class 404, Subclass 112. More particularly, our invention relates to powered, finishing trowels adapted to accommodate bordering walls or other obstacles, and to guards for such trowels.

2. Description of the Prior Art

It is well established in the concrete finishing arts that freshly placed concrete must be finished properly to achieve the desired flatness. As freshly poured concrete "sets", it soon becomes hard enough to support the weight of powered finishing trowels, that are particularly effective for finishing concrete. Walk-behind trowels are ideal for smaller concrete jobs. They are relatively lightweight and, for most purposes, they can be operated and maneuvered by a single workman. Larger, motorized riding trowels are ideal for finishing much larger areas of plastic concrete.

A typical walk-behind trowel comprises a downwardly projecting rotor that contacts the concrete surface and supports the weight of the trowel. Suitable supporting structure mounts an engine to the rotor assembly for power. In most cases internal combustion motors are preferred, but electric motors can be used with trowels. In many cases the rotor is rotated and coupled to the drive motor by a belt-driven, reduction gearbox. An elongated handle, usually pivoted to the frame, extends angularly rearwardly and terminates in a pair of hand grips that are grasped by the operator to control the trowel. The rotor comprises a plurality of radially spaced-apart finishing blades that revolve in frictional contact with the concrete surface. The rotor blades may be twisted about their longitudinal axes for pitch control. Also, the blades may be coupled to circular finishing pans for treating green concrete. A protective guard cage typically surrounds the rotor assembly to prevent inadvertent blade contact with obstacles or human beings.

Preferably, finishing starts with panning while the concrete is still "green", within one to several hours after pouring depending upon the concrete mixture involved. Pan finishing is followed by blade finishing, after the pan is removed from the rotor. In either case the workman manually directs the trowel over the surface regions to be treated. Trowel movement is aided to some extent by the rotating blades of the rotor. For example, when the operator gently lifts or pushes down on the handle, the trowel will help propel itself in a desired direction because of blade forces on the concrete surface.

However, with known trowels it is difficult to finish concrete regions immediately adjacent walls or other obstacles. Conventional guards that protectively shroud the rotor assembly will contact obstacles or walls if the trowel is moved closely into border regions. The annular region between the outermost periphery of the rotor and the guard ring will not be swept by rotor blades. Further, the many vibrational forces generated by a trowel cause instability and surface marring when a normal fixed guard contacts a wall or obstacle. Even if there is some "give" designed into a trowel guard, normal dynamic forces must be balanced properly for the trowel to treat border regions near obstacles in a stable fashion.

Known walk-behind trowels with fixed guard assemblies are disclosed in prior U.S. Pat. Nos. 3,973,857, 4,320,986, 4,752,154, 4,198,178, 4,232,980, 4,673,311, 4,312,603, 4,046,483, 4,027,991, and 4,629,359. A fixed guard for a walk-behind trowel, owned by Allen Engineering Corporation, is seen in U.S. Des. Pat. No. 400,544. The guards seen in the aforementioned references are fixedly attached to supportive structure and cannot rotate in relation to the trowel.

U.S. Pat. Nos. 5,221,156 and 5,533,830 disclose concrete finishing machines comprising a rotatable, disk-shaped guard that is spaced above the revolving finishing blades. The coaxially aligned guard disk contacts adjacent walls and obstacles, and provides a limited guard function. In these machines the guard disk centers are coaxially coupled to downwardly-projecting drive shaft structure at the center of motor rotation. Suitable bearings facilitate mounting. For clearance purposes, rotor guards secured according to the teachings of the latter patents must be relatively flat and disk-like, and they do not completely, angularly shroud edges of the rotor finishing blades. For example, when a user rocks down on the handle of a walk-behind trowel constructed according to U.S. Pat. Nos. 5,221,156 or 5,533,830, the protective disk will be deflected angularly away from and above the obstacle, leaving the unguarded blade edges to detrimentally make contact. Moreover, relatively small force moments applied to edges of such prior art guards are leveraged into potentially damaging or destabilizing forces applied at the center of rotation, compromising trowel stability and performance. Impact forces experienced by the finishing blades are transmitted directly to the guard through the motor drive shaft. Similarly, impact forces suffered by the guard are transmitted directly to the rotor. An unwanted rocking motion can result, destabilizing the trowel.

SUMMARY OF THE INVENTION

We have invented a motor-powered finishing machine (and a guard system for use with such machines) that render it possible to non-destructively finish surface regions adjacent walls or other obstacles. In the best mode, the machine comprises a powered walk-behind trowel for finishing concrete. In the best mode an internal combustion motor supported upon a rigid frame plate drives a gearbox secured beneath the plate. The gearbox revolves a rotor assembly that comprises a plurality of conventional, radially spaced apart finishing blades that frictionally contact the concrete surface being treated.

The preferred guard circumscribes the rotor. The guard is suspended for rotation by a plurality of rollers. Preferably, the guard is of annular form, comprising an inner, upper ring coaxially connected to a larger, lower, outer ring that contacts obstacles. Radially spaced apart spokes extending between the inner and outer rings brace the guard, along with an optional, concentric middle ring. The rollers are mounted by radially, spaced-apart arms that terminate within a bearing. Opposite ends of the arms may be secured to the frame plate, at radially separated points considerably spaced-apart from the center of rotation. Each roller has an upper and lower flange located on opposite sides of a roller surface. The inner ring of the guard is horizontally captivated between the rollers. Vertical guard movements are prevented by the roller flanges that abut opposite edges of the guard inner ring.

Normally the guard does not rotate (i.e., it is not power driven). However, when the guard contacts an obstacle it rolls along smoothly, enabling the power trowel to get as close as possible to concrete surface regions immediately adjacent the obstacle. The guard can rotate and roll along a wall, for example, and forces that destabilize conventional trowels in response to obstacle contact are dissipated.

A basic object of our invention is to provide a surface-finishing machine that adequately treats border regions near walls and obstacles.

Another fundamental object is to provide a guard system that enables finishing machine such as concrete trowels to reach border regions near walls and other obstacles.

Another basic object is to provide a machine of the character described that is adapted to finishing concrete.

A similar object is to provide a power trowel that comes as close as possible to walls and obstacles. In other words, it is an object to properly finish concrete surfaces that closely abut walls and other obstacles.

Another fundamental object of our invention is to provide a walk-behind trowel of the character described that remains safe and stable despite guard impact with nearby walls and obstacles.

A related object is to provide a highly stable guard system that makes it easier for concrete finishing trowels to treat "hard-to-reach" surface regions that border obstacles such as walls and the like.

Another object is to provide a displaceable trowel guard that, in response to obstacle contact, will rotate to preserve trowel stability.

Yet another object is to provide a rotor guard system for power trowels that avoids annoying wobbling and rocking.

A still further object is to provide an impact-responsive guard for power trowels that completely shrouds moving parts.

Still another object is to provide a trowel guard that minimizes potentially destabilizing forces generated in response to obstacle contact.

More particularly, it is an object of our invention to apply forces that result from guard impact with obstacles to portions of the machine that are off-center with respect to the rotor axis.

Another basic object is to provide a trowel guard and a trowel equipped with same that can non-destructively contact obstacles and walls.

Yet another object is to provide a highly stable trowel guard that is suspended for possible impact-responsive rotation at a point as far away as practicable from the axis of rotation.

A related object is to provide a highly stable guard for surface finishing machines that absorbs impact forces at multiple, separated structural points that are spaced well away from the motor drive shaft.

Another object is to provide a powered walk-behind trowel of the character described that flattens the concrete surface sufficiently to attain the high "F-numbers" (i.e., flatness characteristics) that are established by ACI regulations.

Another object is to provide a power finishing trowel of the character described that is highly stable and easy to maneuver while contacting obstacles or walls.

A related object is to provide a walk-behind riding trowel of the character described that readily handles pan finishing and quick curing concrete jobs.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
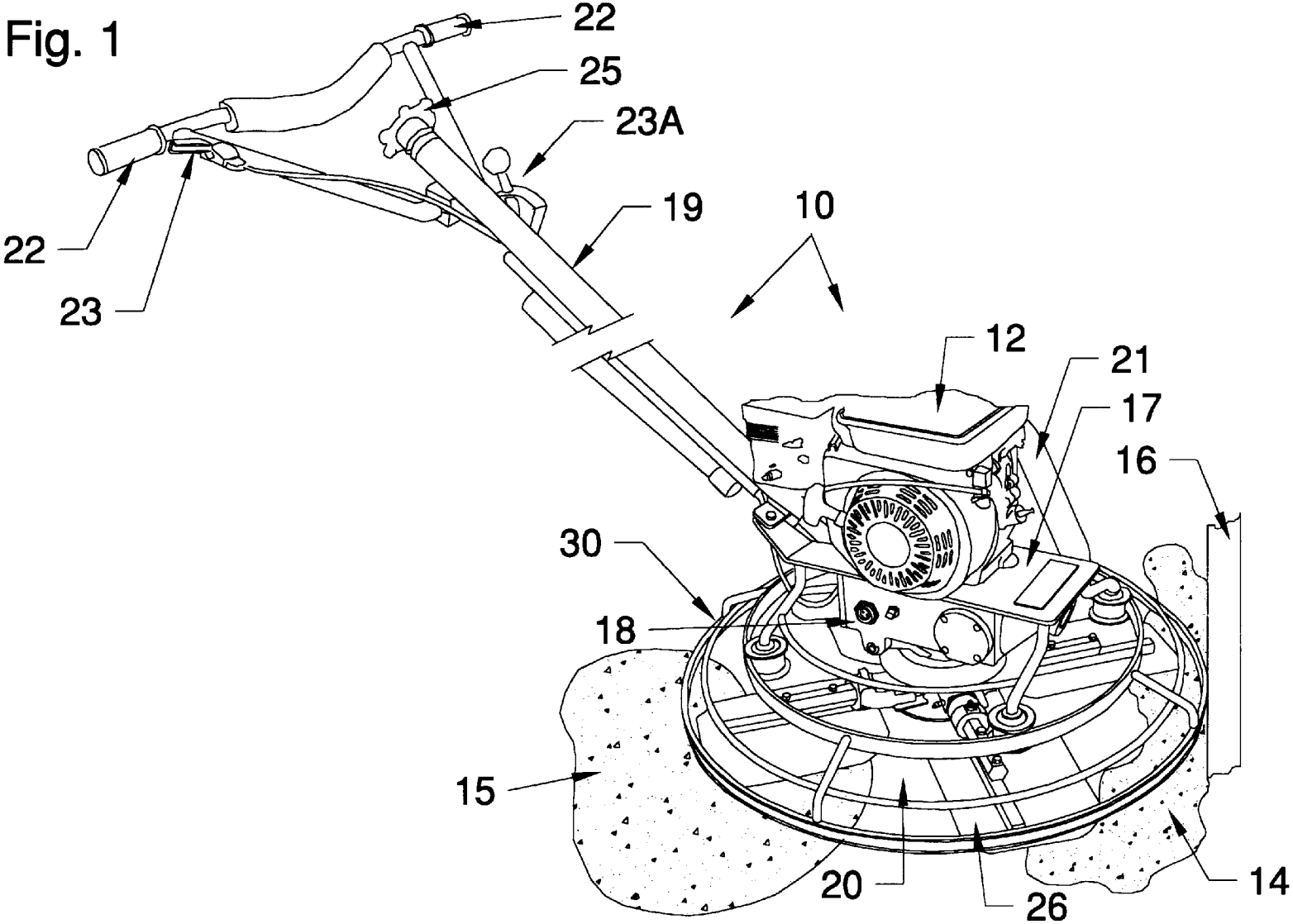
FIG. 1 is a partially fragmentary, perspective view of a surface finishing machine, i.e., a walk-behind concrete finishing trowel, constructed according to the teachings of the present invention, with portions thereof omitted for brevity or broken away for clarity.

With initial reference now directed to FIG. 1 of the accompanying drawings, a motor-powered surface-finishing machine constructed in accordance with our invention has been broadly designated by the reference numeral 10. Machine 10 comprises a walk-behind power trowel, substantial structural details of which are set forth in the U.S. Patents mentioned previously, which for disclosure purposes, are hereby incorporated by reference herein.

Trowel 10 is ideally adapted for finishing concrete surface regions 14 that are adjacent obstacles 16. In the best mode a conventional internal combustion motor 12 sits atop a rigid frame plate 17 that supports a gearbox 18 beneath it. The rotor assembly, generally designated by the reference numeral 20, is revolved by the gearbox 18, which in turn is belt-driven by motor 12. The rotor center of rotation has been generally designated by the reference numeral 13 in FIG. 5.

A shroud 21 that encloses the drive belt and pulleys is seen on the trowel side opposite the viewer in FIG. 1. Those skilled in the art will recognize that the rotor assembly 20 comprises a plurality of conventional, radially spaced apart finishing blades 26 that frictionally contact the concrete surfaces 14, 15 during operation. A conventional handle assembly 19 leads angularly away from the rotor, terminating in spaced hand grips 22. The handle assembly supports conventional throttle control 23, blade pitch lock 23A, and the blade pitch control 25, all of which have been explained in detail in the aforesaid patents.

Figure 2:
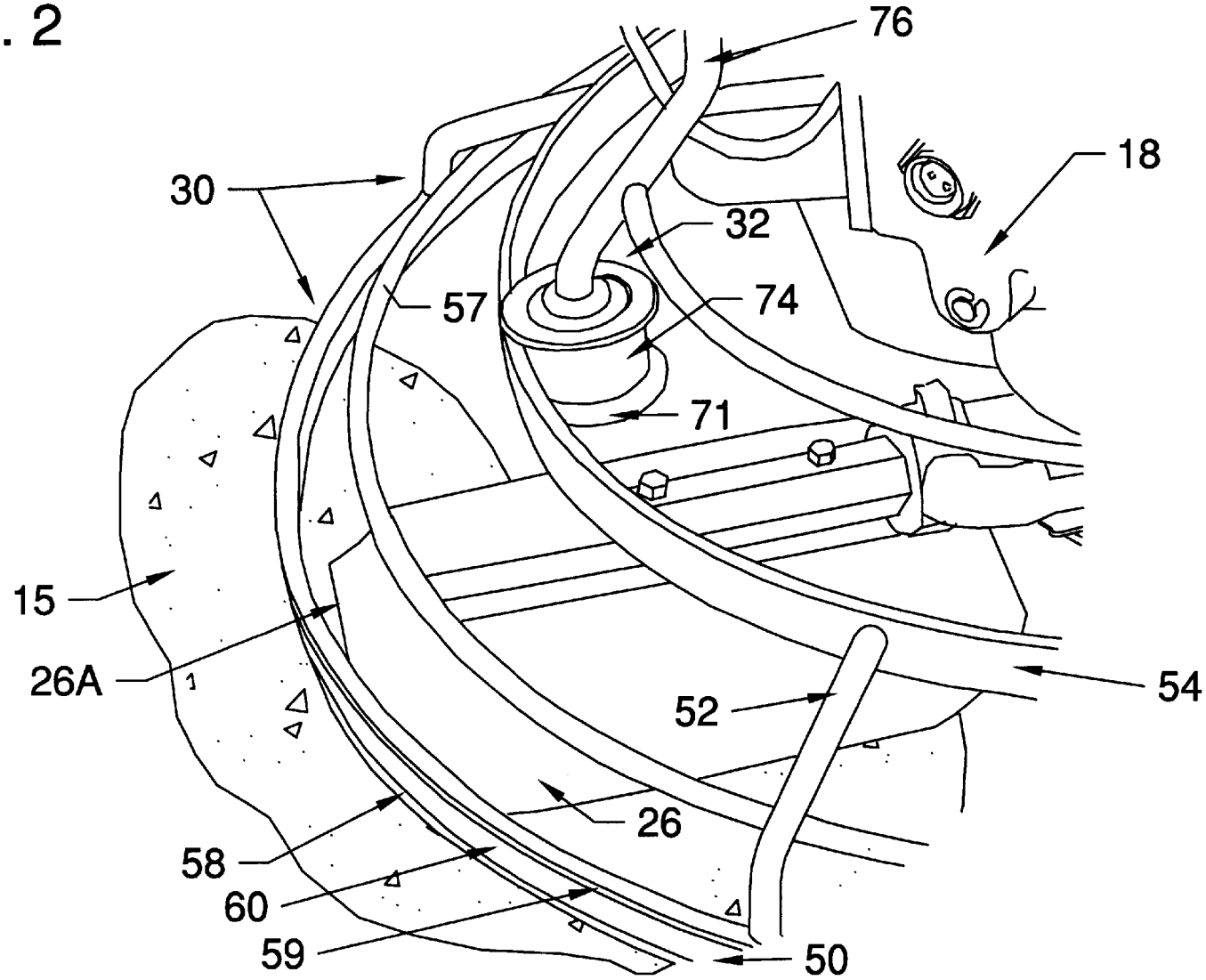
FIG. 2 is an enlarged, fragmentary, perspective view showing the periphery of the preferred guard, with portions thereof broken away for clarity.
Figure 3:
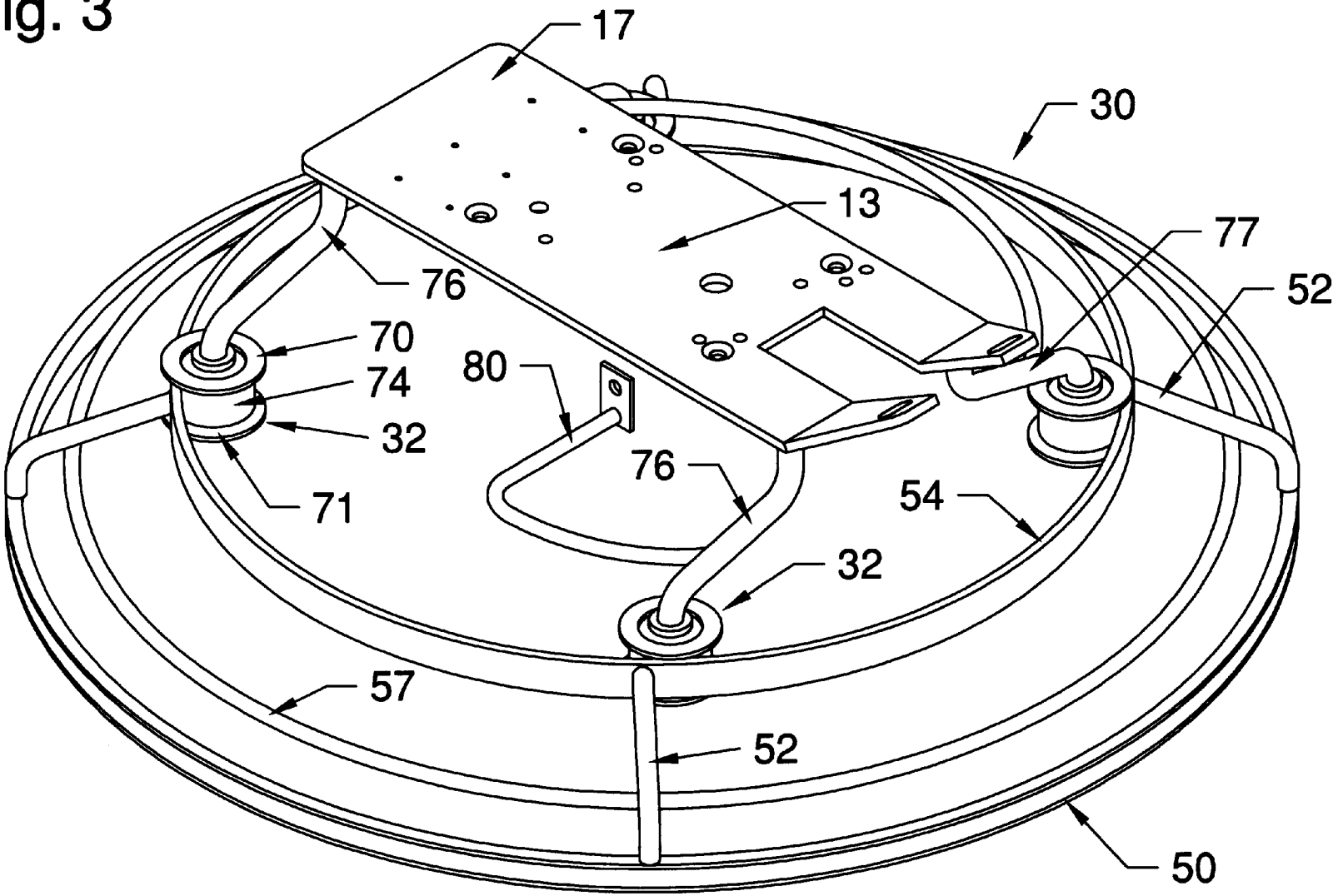
FIG. 3 is an enlarged, front perspective view of the preferred guard assembly.

The outermost tip portions 26A (FIG. 2) of the finishing blades circumscribe a circle whose diameter is slightly exceeded by the effective diameter of the rotatable guard 30. Guard 30 is generally in the form of a truncated cone. It is mounted for possible rotation so that it may be displaced when contacting an obstacle. Preferably it is suspended by and captivated between by a suspension system 31 (FIG. 4) comprising a plurality of rollers 32 (FIG. 2). When guard 30 is moved up against an obstacle 16 (FIG. 1) it can rotate relative to the trowel, and it will not mar the surface of walls or other obstacles it may touch.

With additional reference directed to FIGS. 3–6, the preferred guard 30 comprises an outermost, lower ring 50 that is elevated a slight clearance distance above surface 15 (FIG. 1). A concentrically positioned inner ring 54 is spaced above ring 50. Ring 54 has a diameter less than the diameter of ring 50. A plurality of radially spaced apart spokes 52 extending between rings 50 and 54 reinforce the guard. An optional reinforcement ring 57 is welded to spokes 52 concentrically between rings 50 and 54. Ring 50 preferably has a channel cross section (FIG. 2), comprising a lower flange 58 and an upper flange 59 separated by a recess 60. Preferably a resilient, non-destructive, extrusion (not shown) may be glued into place within recess 60 to prevent ring 50 from marring contacted surfaces. Preferably ring 54 is rolled from a length of flat steel, and the cross section of reinforcing ring 57 is round.

Figure 4:
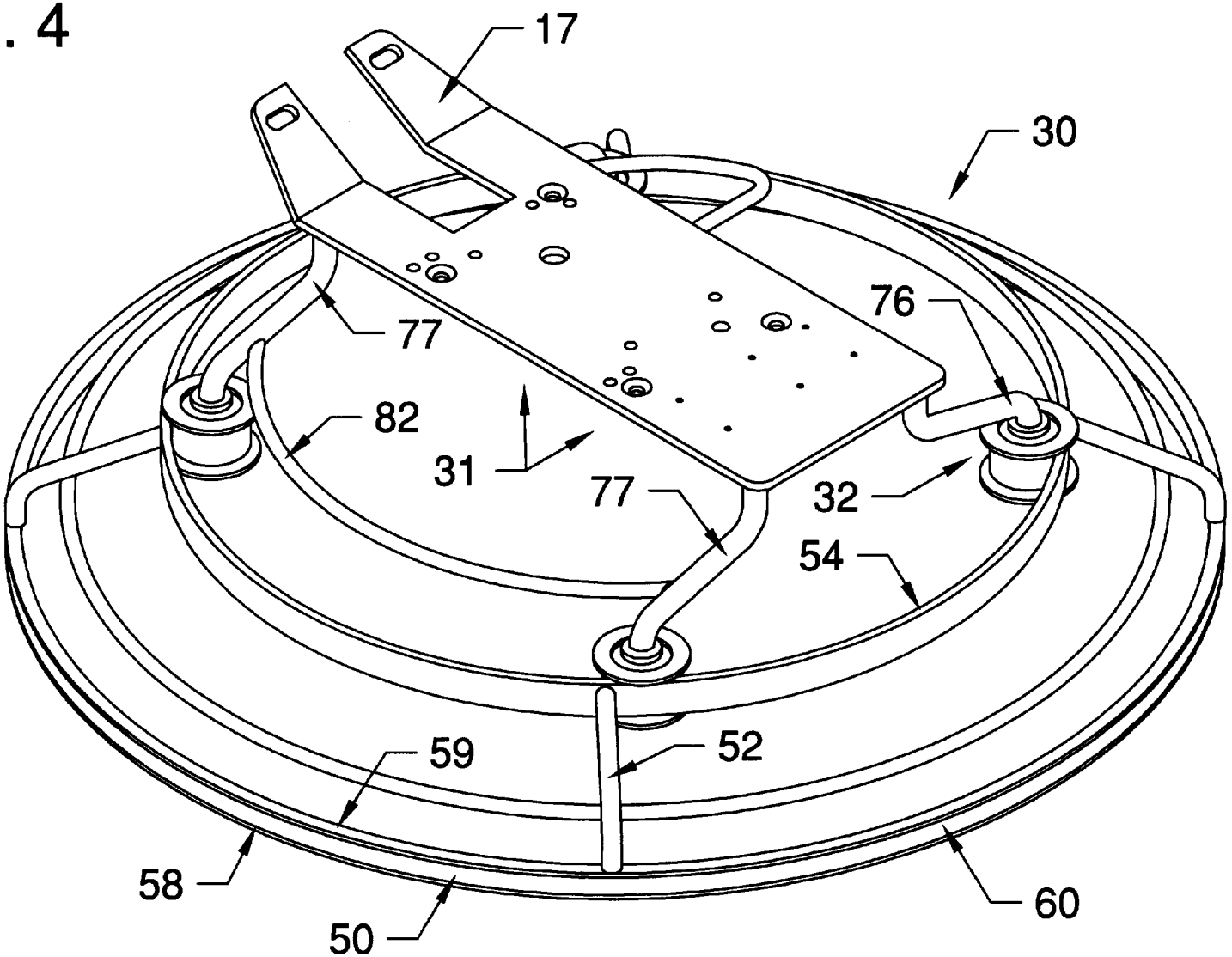
FIG. 4 is an enlarged rear perspective view of the preferred guard assembly; and, FIG. 5 is an enlarged top plan view of the preferred guard assembly.
Figure 5:
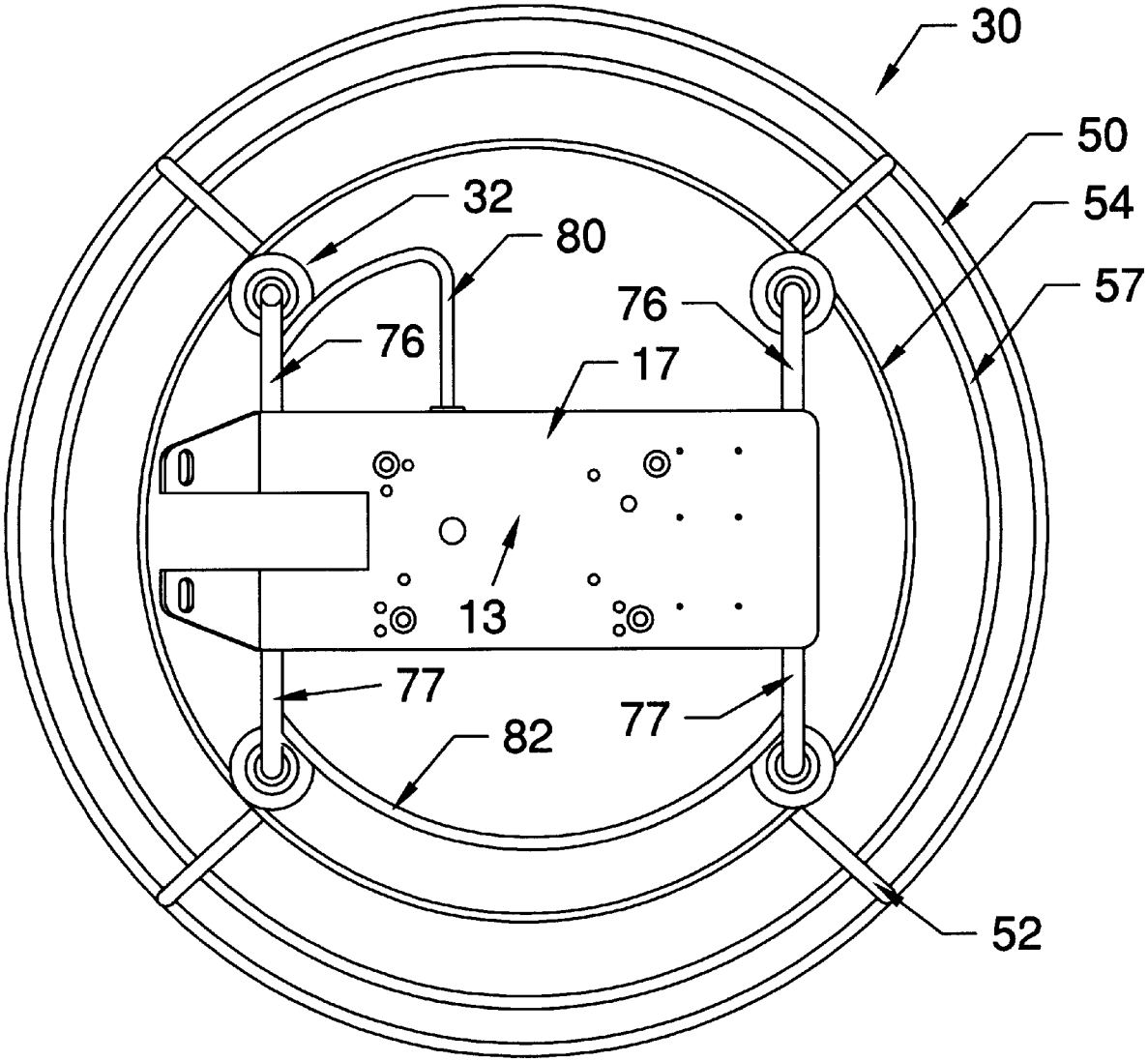

The preferred ring suspension system comprises a plurality of radially paced apart rollers 32. Each roller comprises an upper and lower flange 70, 71 FIG. 3) respectively disposed on opposite sides of a roller surface 74. A pair of radial support arms 76 (FIGS. 3) projecting from beneath one side of frame plate 17 terminate in bearings press fitted within rollers 32. One or more radial arms 76 may be reinforced with a link 80 (FIG. 3) adapted to be secured to the motor gear box 18. The suspension system 31 also comprises companion radial arms 77 projecting from beneath the opposite side of the frame plate 17 (FIGS. 4, 5). These arms also terminate within roller bearings press fitted to rollers that contact the upper guard ring. Arms 77 are preferably connected by arc-shaped reinforcement 82. As best seen in FIG. 5, remote ends of the arms 76, 77 are preferably connected to spaced-apart points of the machine beneath the frame plate 17, considerably spaced apart from the center of rotation 13.

As best appreciated from a study of FIGS. 1–4, the flat, upper guard ring 54 is normally constrained between the radial arms 76, 77 and suitably centered by the rollers 32. Further, the roller flanges 70, 71 captivate ring 54 (and thus guard 30) between flanges 70, 71. Thus vertical guard movement is resisted by the rollers and their flanges 70, 71, while guard movement in a horizontal plane is generally resisted by the inner roller surfaces 74. However, the ring 54, that is contacted and constrained by the rollers, is enabled to rotate around plate 17 (and the rest of the rotor).

Thus, when the guard 30 is pressed against an obstacle 16 (FIG. 1), causing the lower, outer ring 50 to make contact therewith, the guard can rotate, as each roller 32 freely enables ring 54 to revolve. Thus, to an appreciable extent, forces that might otherwise destabilize the trowel or guard, and that might otherwise cause marring of the obstacle surface, are dissipated. In other words it should be appreciated that the guard 30 is annular in form (FIG. 5), occupying the space between inner and outer rings 54 and 50. Support and rotation points are established by the radially spaced apart rollers 32 contacting the inner ring of the annulus (i.e., ring 54). As the guard support points are substantially spaced apart from the center of rotation 13 (FIG. 5) wobbling and destabilizing forces are resisted, and more reliable trowel action results.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A surface finishing machine, said machine comprising:

downwardly projecting rotor means for finishing said surface, the rotor means comprising means for frictionally contacting said surface;

motor means for powering said rotor means;

guard means for shrouding said rotor means, said guard means comprising:

an outer ring substantially coaxial with said rotor means and disposed vertically adjacent said surface to be finished, the outer ring comprising a diameter sufficient for it to circumscribe the outermost portions of said means for frictionally contacting said surface;

an inner ring that is coaxial with and elevated above said outer ring, the inner ring comprising a diameter less than the diameter of said outer ring; and, suspension means spaced apart from said motor means for suspending said guard means for rotation in response to contact with obstacles, wherein said suspension means comprises a plurality of radial arms terminating in rollers.

2. The machine as defined in claim 1 wherein said rollers register with said inner ring to support said guard.

3. The machine as defined in claim 2 wherein said rollers comprise a pair of spaced apart flanges that prevent vertical guard movements and a rolling surface between said flanges that supports and contacts said guard inner ring.

4. A concrete finishing trowel, said trowel comprising:

downwardly projecting rotor means for finishing said concrete, the rotor means comprising means for frictionally contacting said concrete;

motor means for powering said rotor means;

guard means for shrouding said rotor means, said guard means comprising:

an outer ring substantially coaxial with said rotor means and disposed adjacent said concrete to be finished, the outer ring comprising a diameter sufficient for it to circumscribe the outermost portions of said means for frictionally contacting said concrete;

an inner ring that is coaxial with and elevated above said outer ring, the inner ring comprising a diameter less than the diameter of said outer ring; and, suspension means spaced apart from said motor means for suspending said guard means for rotation in response to contact with obstacles, wherein said suspension means comprises a plurality of arms terminating in rollers.

5. The trowel as defined in claim 4 wherein said rollers register with said inner ring to support said guard.

6. The trowel as defined in claim 5 wherein said rollers comprise a pair of spaced apart flanges that prevent vertical guard movements and a rolling surface between said flanges that supports and contacts said guard inner ring.

7. A power trowel for finishing concrete, said trowel comprising:

a rotatable finishing rotor projecting downwardly from said trowel, the rotor comprising a plurality of radially spaced-apart blades that frictionally contact the concrete, and a center of rotation;

a motor for powering said rotor; and, a guard for shrouding said rotor, said guard comprising:

a lower, outer ring substantially coaxial with said rotor, the outer ring comprising a diameter sufficient for it to circumscribe the outermost tips of the rotor blades;

an upper, inner ring that is coaxial with and elevated above said outer ring, the inner ring comprising a diameter less than the diameter of said outer ring; and, a plurality of radially spaced-apart rollers for suspending said guard for rotation in response to contact with obstacles.

8. The trowel as defined in claim 7 further comprising a frame plate for securing said motor, and wherein said radially spaced-apart rollers are supported by a corresponding plurality of radially, spaced-apart arms extending from said frame plate at points on said plate substantially separated from said center of rotation.

9. The trowel as defined in claim 7 wherein said rollers comprise a pair of spaced apart flanges that captivate said upper inner ring to prevent vertical guard movements, and a rolling surface between said flanges that supports and contacts said inner ring to prevent guard movement in a horizontal plane.

10. The trowel as defined in claim 7 wherein the guard is in the form of an annulus, said inner ring forms the innermost rolling surface of said annulus, and said plurality of radially spaced-apart rollers for suspending said guard for rotation are spaced apart from the center of rotation and directly contact said innermost rolling surface of said annulus.

11. A power walk behind trowel for finishing concrete, said trowel comprising:

a rigid frame plate;

a handle for controlling said trowel;

a motor on said frame plate for powering said trowel;

a rotatable finishing rotor driven by said motor that projects downwardly from said frame plate, the rotor comprising a plurality of radially spaced-apart blades that frictionally contact the concrete, and a center of rotation;

a guard for shrouding said rotor, said guard comprising:

a lower, outer ring substantially coaxial with said rotor, the outer ring comprising a diameter sufficient for it to circumscribe the outermost tips of the rotor blades;

an upper, inner ring that is coaxial with and elevated above said outer ring, the inner ring comprising a diameter less than the diameter of said outer ring;

means for coupling the upper and lower rings coaxially together; and, a plurality of radially spaced-apart rollers for suspending said guard for rotation in response to contact with obstacles.

12. The trowel as defined in claim 11 wherein said radially spaced-apart rollers are supported by a corresponding plurality of radially, spaced-apart arms extending from said frame plate at points on said plate substantially separated from said center of rotation.

13. The trowel as defined in claim 12 wherein said rollers comprise a pair of spaced apart flanges that captivate said upper inner ring to prevent vertical guard movements, and a rolling surface between said flanges that supports and contacts said inner ring to prevent guard movement in a horizontal plane.

14. The trowel as defined in claim 12 wherein the guard is in the form of an annulus, and said inner ring forms the innermost rolling surface of said annulus, and said plurality of radially spaced-apart rollers for suspending said guard for rotation are spaced apart from the center of rotation and directly contact said innermost rolling surface of said annulus.

15. A guard for shrouding a power trowel rotor of the type comprising a plurality of radially spaced-apart blades that frictionally contact the concrete, said guard comprising:

an outer ring substantially coaxial with said rotor, the outer ring comprising a diameter sufficient for it to circumscribe tips of the rotor blades;

an inner ring that is coaxial with and elevated above said outer ring, the inner ring comprising a diameter less than the diameter of said outer ring; and, suspension means spaced apart from a center of said rotor for suspending said guard for rotation in response to contact with obstacles, wherein said suspension means comprises a plurality of radial arms fastened at an inner end to trowel structure and that terminate at an outer end in rollers.

16. The guard as defined in claim 15 wherein said rollers register with said inner ring to support said guard.

17. The trowel as defined in claim 16 wherein said rollers comprise a pair of spaced apart flanges that prevent vertical guard movements and a rolling surface between said flanges that supports and contacts said guard inner ring.

* * * * *